United States Patent [19]

Watkins

[11] 4,202,056

[45] May 13, 1980

[54] TOILET WATERFALL

[76] Inventor: Christopher A. Watkins, 225 Estates Dr., Ben Lomond, Calif. 95005

[21] Appl. No.: 752,605

[22] Filed: Dec. 20, 1976

[51] Int. Cl.[2] ..... A47K 17/00

[52] U.S. Cl. ..... 4/1; 239/17

[58] Field of Search ..... 4/1, 18, 252, 415; 239/17-23, 289; 272/15, 26; 40/406, 409

[56] References Cited

U.S. PATENT DOCUMENTS

| | | | |
|---|---|---|---|
| 3,022,010 | 2/1962 | Barnett | 239/17 |
| 3,879,768 | 4/1975 | Murphy | 4/1 |

*Primary Examiner*—Houston S. Bell, Jr.
*Attorney, Agent, or Firm*—Paul B. Fihe

[57] ABSTRACT

A toilet waterfall including a cover member arranged to fit on the open top of a flush tank of a conventional toilet and having a series of drip pans supported thereabove in superposed, staggered relationship so that water delivered upon flushing of the tank will be delivered through a suitable conduit to the uppermost drip pan to create a series of small waterfalls and another conduit for return of the water ultimately into the flush tank itself.

3 Claims, 2 Drawing Figures

TOILET WATERFALL

FIELD OF THE INVENTION

The present invention relates generally to toilet facilities and more particularly to a toilet waterfall which can be operatively associated with the flush tank of a conventional toilet.

BACKGROUND OF THE INVENTION

The conventional household toilet provides for automatic operation under the control of a float-controlled valve to replenish the water supply to the flush tank after each use. Conventionally, the flush tank is closed by a plain cover which essentially seals the water from the surrounding air and the same can actually become stagnant unless use is extremely frequent. Furthermore, while most bathrooms include decorative lights, mirrors, tile work, and other aesthetically desirable facilities, the general toilet is a plain and very drab structure.

SUMMARY OF THE PRESENT INVENTION

It is accordingly the primary objective of the present invention to provide a toilet waterfall arranged to replace the cover on the conventional flush tank of a toilet to provide what is at one and the same time an aesthetically desirable unit and one which effects both humidification of the atmosphere and aereation of the water delivered ultimately to the flush tank.

Briefly, such objective is achieved by a toilet waterfall which includes a base member which forms a cover that is adapted to replace the conventional cover on the flush tank of a toilet. A series of small drip pans are supported by such cover in superposed, staggered relationship, thus to provide a series of small waterfalls from one drip pan to the next lower pan upon delivery of water to the uppermost drip pan.

The source of water is provided by a simple conduit that can be connected to the end of the existent water inlet for the flush tank so that upon the occasion of each flushing and subsequent opening of the conventional float-controlled valve, a supply of water is delivered to the uppermost end of the conduit where it may successively fall from one drip pan to another thus to be finally delivered to a second conduit that is connected between the lowermost one of the drip pans and the flush tank itself. During such waterfall operation, it is quite clear that any dust particles in the air will tend to adhere to the water and thus be delivered to the flush tank for subsequent disposal down the existent sewer system. In addition, the exposure of the water in waterfall fashion to the air both effects a humidification of the air and an aereation of the water so that it is less likely to become stagnant even though left in the flush tank for an extended period.

Preferably, in order to control the amount of water delivered on the occasion of each flushing operation, a bypass conduit is connected to the delivery conduit so that a portion of the water can be returned directly to the flush tank to avoid overfilling of the drip pans and spilling of excess water. In conjunction with such bypass, a small manually operated valve is arranged upon variation in its setting, to control the precise amount of water that is delivered to the waterfall mechanism.

BRIEF DESCRIPTION OF THE DRAWING

The stated objective of the invention and the manner in which it is achieved, as summarized hereinabove, will be more readily understood by reference to the following detailed description of the exemplary embodiment of the invention shown in the accompanying drawing wherein.

DETAILED DESCRIPTION OF THE EXEMPLARY EMBODIMENT OF THE INVENTION

Figure 2:
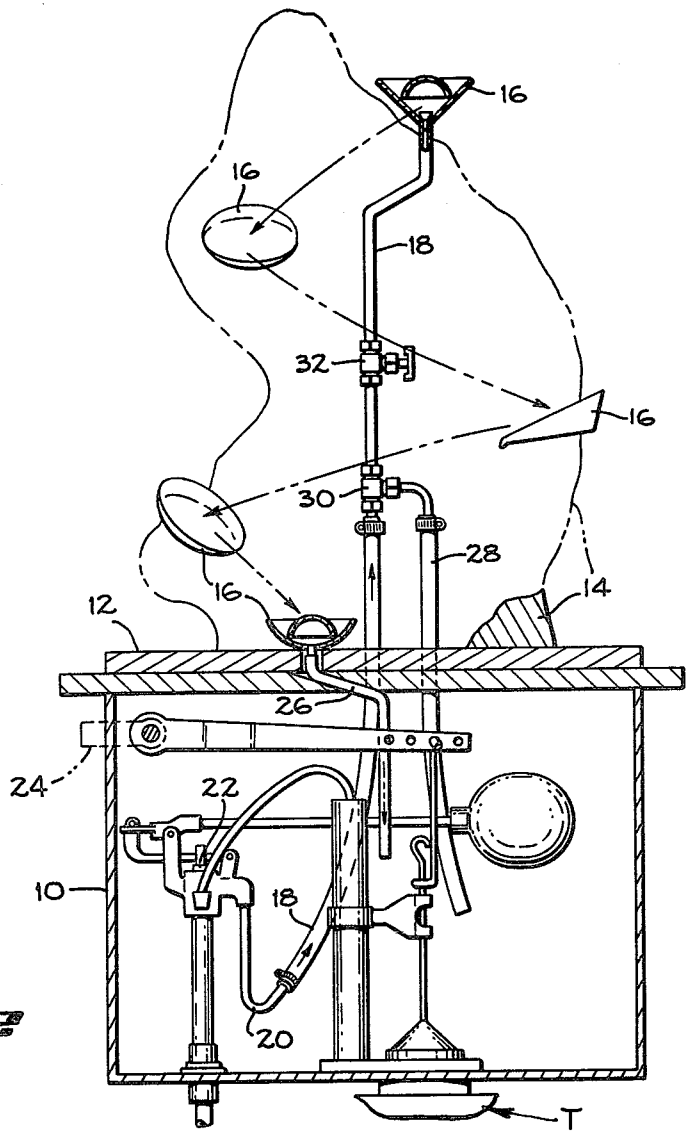
FIG. 2 is a central vertical view taken along line 2—2 of FIG. 1 to illustrate additional details of the operating structure.
Figure 1:
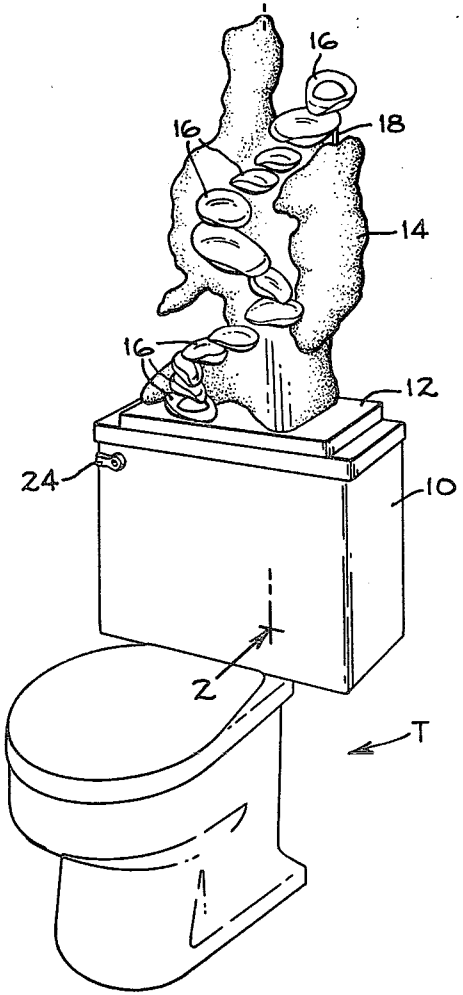
FIG. 1 is a perspective view of a toilet waterfall mounted on a conventional toilet.

As shown in the drawing, the toilet waterfall embodying the present invention is arranged for mounting on the open top of the flush tank 10 of a conventional toilet T after the existing cover for the flush tank has been removed.

More particularly, the toilet waterfall includes a cover 12 that is adapted to be mounted removably on the open top of the flush tank 10 being appropriately dimensioned for this purpose. Such cover 12 provides a base for an upstanding bracket 14 which can be of any decorative design and in turn is arranged to support in superposed, staggered relationship, a number of drip pans 16, each of which is in the form of a shallow concave structure having a depressed lip at one position immediately above the center of the next lower drip pan. Accordingly, if water is delivered to the uppermost drip pan 16, it will gradually drip from one pan to the one thereunder in sequence, thus to create a series of small waterfalls.

With specific reference to FIG. 2, water is supplied to the uppermost drip pan 16 by a conduit 18 whose upper open extremity overlies the uppermost drip pan and whose lower end extends through the cover. The lower end of the conduit 18 is formed preferably by flexible material so that it can be attached to the existing water inlet 20 to the flush tank 10 which is controlled by a float-controlled valve 22 in a conventional fashion. Accordingly, when the flushing handle 24 is depressed, existent water within the flush tank flushes the toilet bowl in a conventional fashion and when the valve automatically opens, water is delivered upwardly through this conduit 18 to be discharged into the uppermost drip pan 16 for successive flow from one drip pan to another until it arrives at the lowermost drip pan which is, in turn, connected by a short conduit 26 to the interior of the flush tank 10 so that such flush tank will ultimately be filled to raise the float and thus close the valve 22 preparatory to an additional flushing operation. A check valve 27 is positioned at the upper extremity of the conduit 18 to preclude a return flow of water at the completion of the flushing cycle.

So that the amount of water flowing from one drip pan 16 to another and ultimately back into the flush tank 10 can be controlled to avoid particularly excessive amounts which would cause overflow, a bypass conduit 28 is connected by a T-connector 30 to the first delivery conduit 18 and extends downwardly through the cover 12 into the flush tank 10 and immediately above this bypass conduit 28, a small control valve 32 that can be manually operated to effect greater or lesser opening can be adjusted so that a portion of the water will pass upwardly to the drip pans 16 and the remainder will be diverted through the bypass conduit 28 directly into the flush tank 10.

During the operation, the water in the series of small waterfalls is, of course, exposed to the air in the bathroom and is aerated as it drops from one drip pan 16 to another, will pick up any dust particles in the vicinity and finally will also effect some humidification of the air in the room.

These desirable functional effects are, of course, supplemented by the aesthetically desirable appearance of the entire unit which can take various designs depending upon the desired decor in a particular installation.

Various structural alterations and modifications can be envisioned within the general spirit of the invention and the foregoing description of one embodiment is accordingly to be considered as purely exemplary and not in a limiting sense and the actual scope of the invention is to be indicated only by the appended claims.

What is claimed is:

1. A toilet waterfall for a standard flush tank including a water inlet which comprises a cover arranged to rest on the open top of the toilet flush tank, a series of drip pans supported above and by said cover in staggered and superposed relation, a first conduit arranged for connection to the water inlet of the flush tank at one end and to discharge water into the uppermost one of said drip pans at its opposite end, and a second conduit connected between the lowermost one of said drip pans and said flush tank.

2. A toilet waterfall according to claim 1 which comprises a bypass conduit connected between said first conduit and said flush tank.

3. A toilet waterfall according to claim 2 which comprises a valve in said first conduit beyond said bypass conduit in the direction of water flow.

* * * * *